US005235959A

United States Patent [19]

Frank et al.

[11] Patent Number: 5,235,959

[45] Date of Patent: Aug. 17, 1993

[54] ARRANGEMENT AND METHOD FOR REGENERATING ROTATING PRECISION GRINDING TOOLS

[75] Inventors: Heinz Frank, Aalen; Yaolong Chen, Aalen-Unterkochen; Holger Fiedler, Aalen, all of Fed. Rep. of Germany

[73] Assignee: Carl-Zeiss-Stiftung, Heidenheim, Fed. Rep. of Germany

[21] Appl. No.: 912,274

[22] Filed: Jul. 13, 1992

[30] Foreign Application Priority Data

Jul. 18, 1991 [DE] Fed. Rep. of Germany ..... 4123850

[51] Int. Cl.[5] ..... B24B 53/00

[52] U.S. Cl. ..... 125/11.01; 51/317; 51/325

[58] Field of Search ..... 125/11.01; 51/59 SS, 51/317, 325, 292, 267, 321

[56] References Cited

U.S. PATENT DOCUMENTS

| | | | |
|---|---|---|---|
| 2,858,652 | 11/1958 | Luthman et al. | 51/59 SS |
| 4,027,648 | 6/1977 | Bonnice | 125/11.01 |
| 4,226,055 | 10/1980 | Komanduri et al. | 125/11.01 |
| 4,712,334 | 12/1987 | Ikezaki et al. | 125/11.01 |

FOREIGN PATENT DOCUMENTS

| | | | |
|---|---|---|---|
| 244517 | 4/1987 | Fed. Rep. of Germany . | |
| 244518 | 4/1987 | Fed. Rep. of Germany . | |
| 50-103767 | 3/1977 | Japan . | |
| 50-104208 | 3/1977 | Japan . | |
| 50-104684 | 3/1977 | Japan . | |
| 0048892 | 4/1977 | Japan | 125/11.01 |
| 56-155734 | 4/1983 | Japan . | |
| 2067935 | 5/1984 | United Kingdom | 51/165.72 |

OTHER PUBLICATIONS

IBM Technical Disclosure Bulletin vol. 16, No. 5, "Dressing a Grinding Wheel", Robinson et al., (Oct. 1973).

*Primary Examiner*—Robert A. Rose
*Attorney, Agent, or Firm*—Walter Ottesen

[57] ABSTRACT

The invention is directed to an arrangement for regenerating rotating precision grinding tools with a dressing tool and with a loose abrading medium suspended in a liquid and introduced into a gap between the dressing tool and the grinding tool. The dressing tool has approximately the negative desired form of the grinding tool and the dressing tool has bonded abrading grains in this surface region. Preferably, the grinding tool is rotated on the work spindle and the dressing tool is also moved.

9 Claims, 4 Drawing Sheets

ARRANGEMENT AND METHOD FOR REGENERATING ROTATING PRECISION GRINDING TOOLS

FIELD OF THE INVENTION

The invention relates to an arrangement and a method for regenerating rotating precision grinding tools having a dressing tool and loose abrading means suspended in a liquid in a gap between the grinding tool and the dressing tool.

BACKGROUND OF THE INVENTION

German Patent DD 244,518 discloses an arrangement for restoring the bevel angle and end width of a diamond circular cutter. A grinding surface free of abrading material and having the form of a spherical cap effects a line contact along the entire periphery of the circular cutter. The circular cutter is resiliently and pivotally held. The arrangement is separate from the grinding machine.

The running precision of rotating grinding tools is of decisive significance for obtaining high precision with precision or ultraprecision grinding. Up until now, the running precision of grinding tools was obtained in that the grinding tools were dressed by a single-grain or multiple-grain dressing device. Since such dressing devices operate theoretically only on point or line contact, the cutting force is concentrated on a small surface during dressing where the dressing device and the grinding tool are stressed at high pressure. As a consequence of the small contact surface, dressing device and grinding tool cannot be adequately braced with respect to each other. For this reason, the dressing process is very sensitive with respect to process disturbances such as run-out errors present on the grinding tool, vibrations, changes of the cutting force, et cetera. This leads to very time-consuming dressing processes or to an unwanted limited end-run precision.

SUMMARY OF THE INVENTION

It is an object of the invention to provide an arrangement and a method for regenerating rotating precision grinding tools which result in significantly reduced form errors of the grinding tool with the grinding tools having a variety of forms and with reduced processing times.

The arrangement of the invention is for regenerating a rotating precision grinding tool having a grinding surface which is to be dressed to define a desired shape. The arrangement includes: a dressing tool including a body having a surface region formed to have approximately the negative shape of the desired shape of the grinding surface of the grinding tool; the grinding tool and the dressing tool being positioned relative to each other so as to cause the grinding surface and the surface region to conjointly define a gap therebetween; the dressing tool carrying bonded abrading grains in the surface region; and, supply means for supplying loose abrading means suspended in a liquid to the gap.

According to a feature of the invention, the dressing tool has in one surface region approximately the negative of the desired form of the grinding tool and the dressing tool has bonded cutting grains in this surface region. With the first feature of the invention, the problems associated with line contact are resolved by expanding the surface contact. This is done indirectly via the loose abrading means. It has been an unexpected result that applying bonded abrading grains to the dressing tool affords advantages with respect to the removal capacity, suppression of periodic residual errors and for service life even though the dressing tool is not in direct contact with the grinding tool.

It is especially advantageous that the grinding tool can remain on the work spindle since adjusting errors when clamping onto the work spindle are precluded and assembly time for clamping on two machines is unnecessary.

An advantageous application of the arrangement according to the invention is for dressing circular diamond cutters for the ductile processing of optical glass.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
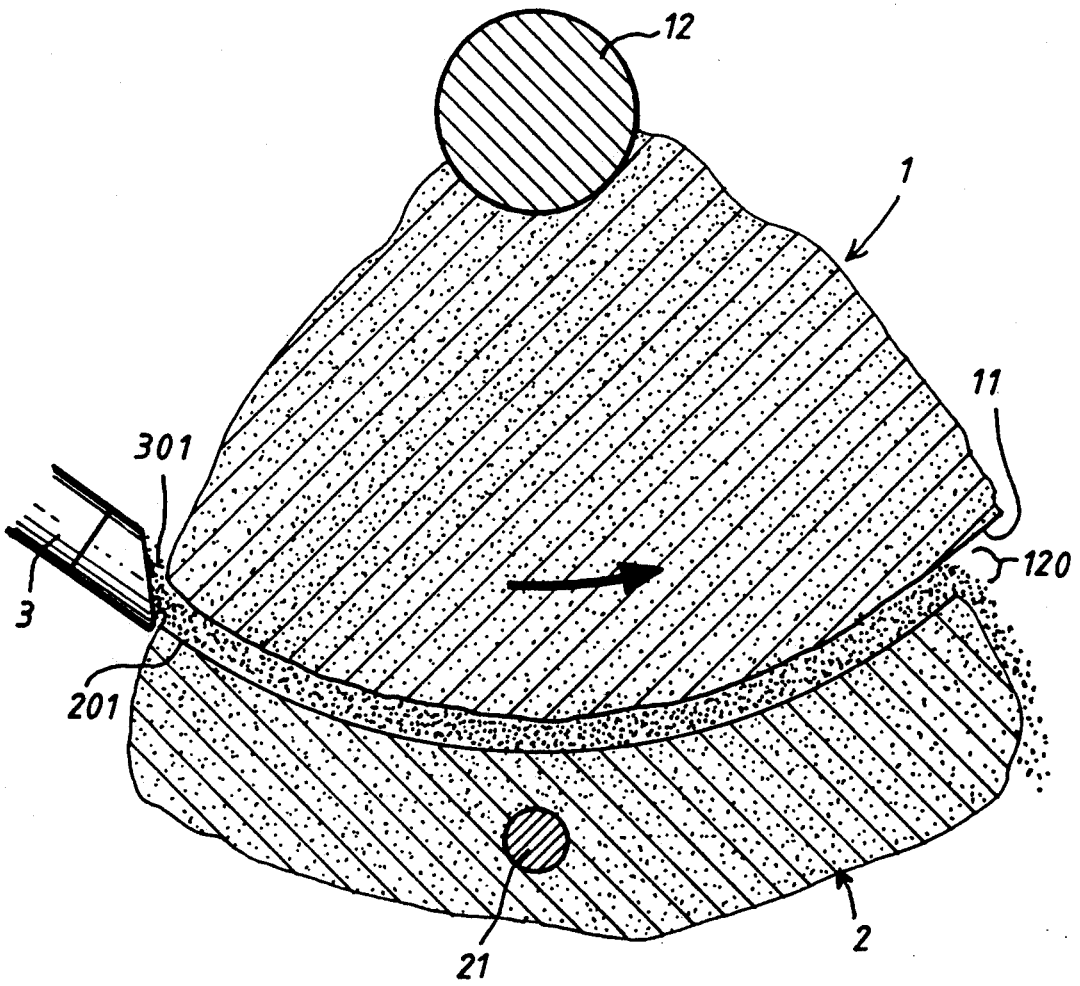
FIG. 1 is a section view, not to scale, through the work zone of an embodiment of the arrangement according to the invention.

FIG. 1 is an axial view of a portion of a grinding tool configured as a grinding disc having a bonded abrading grain 11 on its periphery. The grinding tool 1 is driven at its rotational shaft 12 for grinding and dressing.

A dressing tool 2 having bonded grinding grain 201 on its work surface follows with a gap 120 as the negative of the desired form of the grinding tool 1 on a work surface expanded axially and radially. The dressing tool 2 can carry out an oscillating movement (arrow 4) perpendicularly to the section plane by means of a drive 21.

Loose abrading material 301 suspended in a liquid is supplied from a feed pipe 3 and introduced between the grinding tool 1 and the dressing tool 2. With this combination, the rotating grinding tool 1 is processed at its surface by the loose abrading material 301.

The cutting forces are reduced with respect to conventional dressing devices by the distribution on a surface and are stochastically distributed by the loose abrading means 301.

Errors distributed systematically over the grinding tool 1 are effectively prevented. The additional movement of the dressing tool 2 prevents possible surface errors of the dressing tool 2 from being transferred to the grinding tool since they are averaged out. Such surface errors of the dressing tool could otherwise be transferred, for example, by a constant deviating cutting force on a peripheral line.

Coating the dressing tool with abrading means 201 provides, on the one hand, protection against wear by the loose abrading means 301. On the other hand, the performance of the loose abrading means 301 is positively influenced when running through the gap 120 and thereby increases the removal action and the quality of the surface. Cutting force and removal action of the arrangement can be varied and adjusted by the selection of the loose abrading means 301 as well as by the coating of the dressing tool 2 with respect to material, grain and concentration in the suspension as well as by the width of the gap 120 between the grinding tool 1 and the dressing device 2. Diamond is suitable as a loose and bonded abrading means (11, 201, 301). In addition, other conventional abrading means or lapping means can be used.

The thickness of the abrading means 201 on the dressing tool 2 can be made as desired so that also normal massive grinding discs made of bonding means and abrading grain are suitable.

Figure 2B:
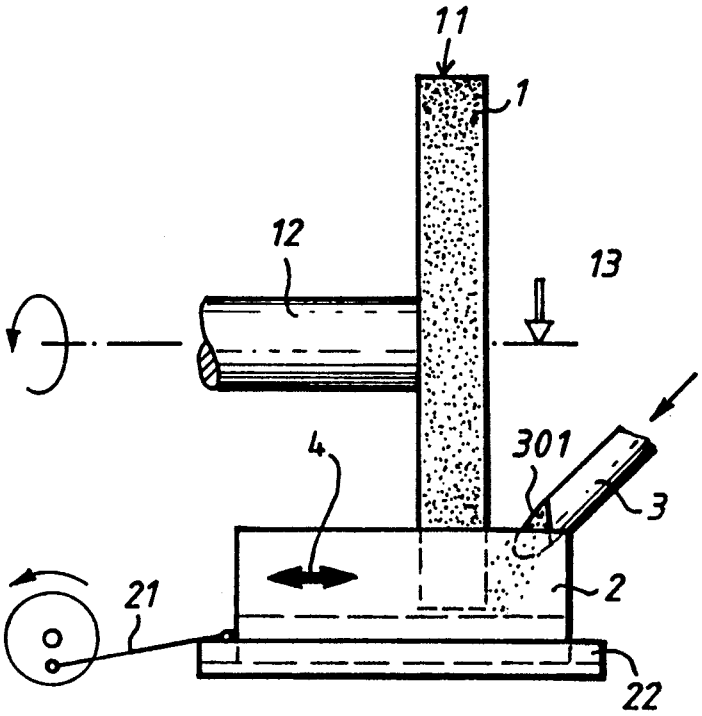
FIG. 2B is a side elevation view of the arrangement shown in FIG. 2A.
Figure 2A:
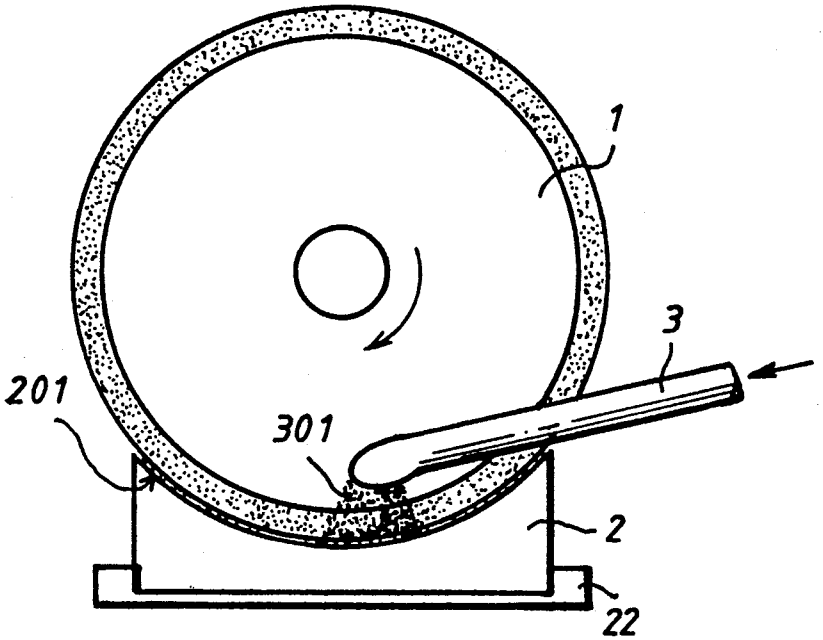
FIG. 2A is an end view of the arrangement of FIG. 1 together with a cylindrical grinding tool.

FIG. 2A shows an axial overall view of the arrangement of the invention with a cylindrical grinding tool 1 wherein the same parts have the same reference numerals as in FIG. 1. FIG. 2B shows the same arrangement as in FIG. 2A but in a radial view. The grinding disc 1 is seated on a shaft 12 having a rotational drive and is rotated when dressing as when grinding. A placement device is schematically represented by arrow 13 by means of which the position of the shaft 12 can be displaced in order to adjust the gap 120 (FIG. 1) and to balance the removal on the grinding surface 11 of the grinding tool 1 by the dressing process.

The axially oscillating movement of the dressing tool 2 is realized, for example, by a crank drive 21 in combination with a longitudinal guide 22 as shown.

Figure 3B:
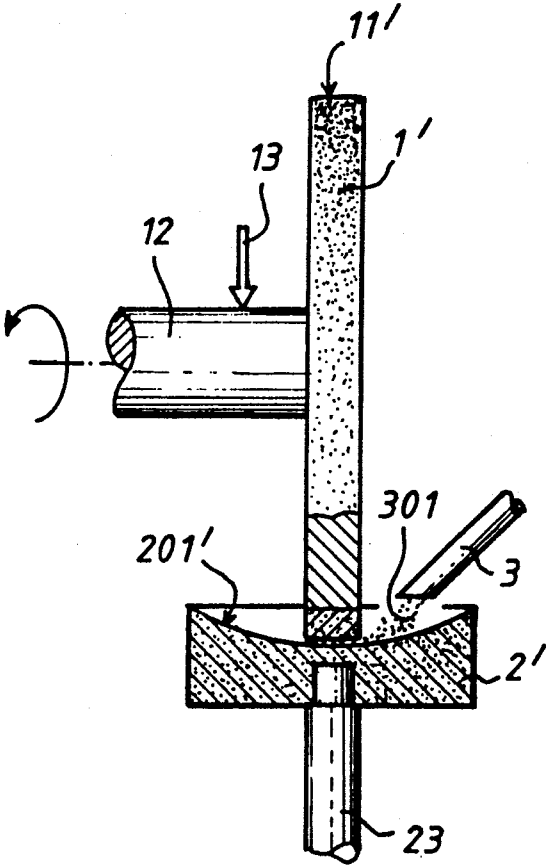
FIG. 3B is a side elevation view of the arrangement of FIG. 3A; 25
Figure 3A:
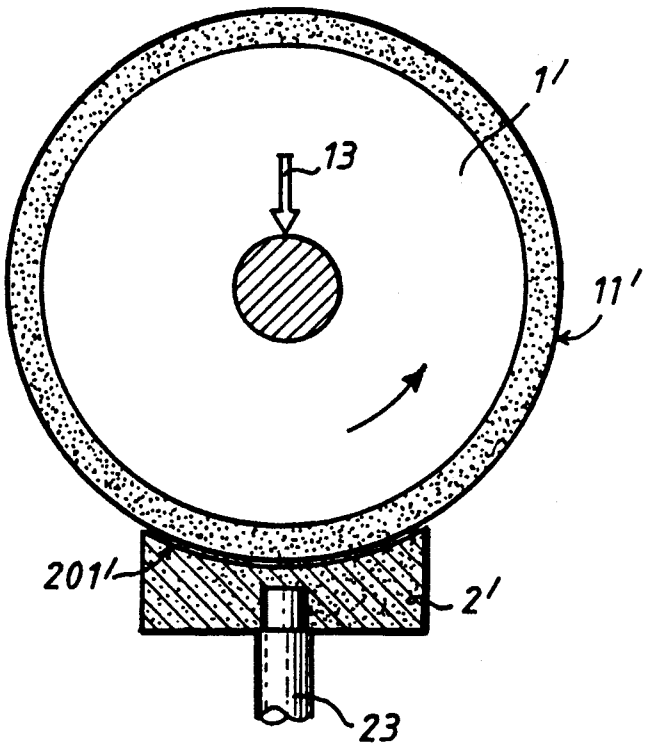
FIG. 3A is an end view of an embodiment of the arrangement of the invention together with a grinding tool in the form of a spherical layer.

FIGS. 3A and 3B show an alternate grinding tool 1 having a grinding surface corresponding to the surface of a layer of a sphere. The same parts are provided with the same reference numerals as in FIGS. 1, 2A and 2B.

In this embodiment of the grinding tool, the condition is obtained that the relative velocity vector during the dressing operation is not colinear with that of the grinding operation. In this way, the occurrence of dressing structures on the surface of the tool is prevented which otherwise could be later impressed on the workpiece to be processed.

The dressing tool 2' is adapted to the form of a spherical grinding surface 11' and is configured as a spherical cap. In lieu of the oscillating drive 21 of FIGS. 2A and 2B, a rotating drive shaft 23 is provided in this embodiment which rotatingly drives the dressing tool 2' about the longitudinal axis of the shaft 23.

A diamond grinding disc of model "Gresso D15A-C 100" manufactured by the Ernst Winter und Sohn Company of 2000 Norderstedt 1, Germany, has a diameter of 150 mm and a width of 3 mm. If this grinding disc is dressed with a dressing tool 2' of 30 mm diameter having a grain mesh size of 200 at 200 rpm and with a gap 120 having a width of less than 15 μm and with a loose diamond of 20 μm suspended in water, then, after normal wear of the grinding tool 1, a concentricity of the grinding disc of approximately 0.2 μm is obtained within 10 minutes.

This construction is also suitable for a grinding tool 1' in the form of an off-center spherical layer with the shaft 23 then being correspondingly displaced laterally.

Other forms of grinding tools (1, 1') can be regenerated, in part by dispensing with the additional movement of the dressing tool (2, 2'), with the arrangement of the invention after a corresponding adaptation of the dressing tool (2, 2'). The following are examples: truncated conical section, double truncated conical section, toroidal and barrel-shaped bodies, ellipsoids and paraboloids.

Figure 4B:
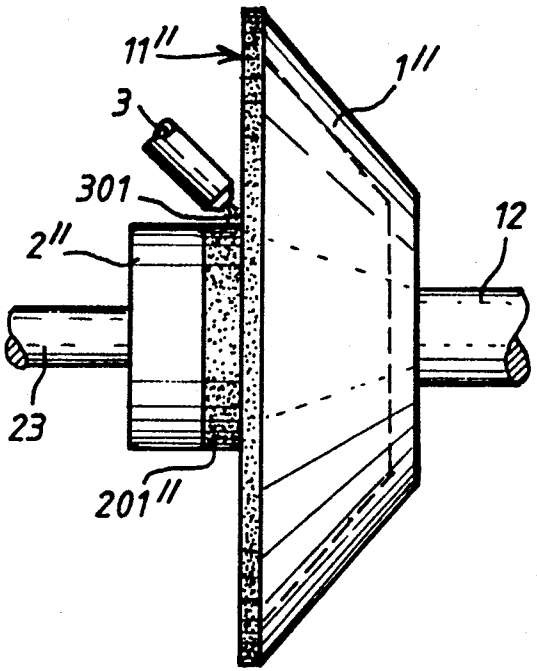
FIG. 4A is an end view of an arrangement of the invention together with a grinding tool having the shape of a truncated cone; and, FIG. 4B is a side elevation view of the arrangement shown in FIG. 4A.
Figure 4A:
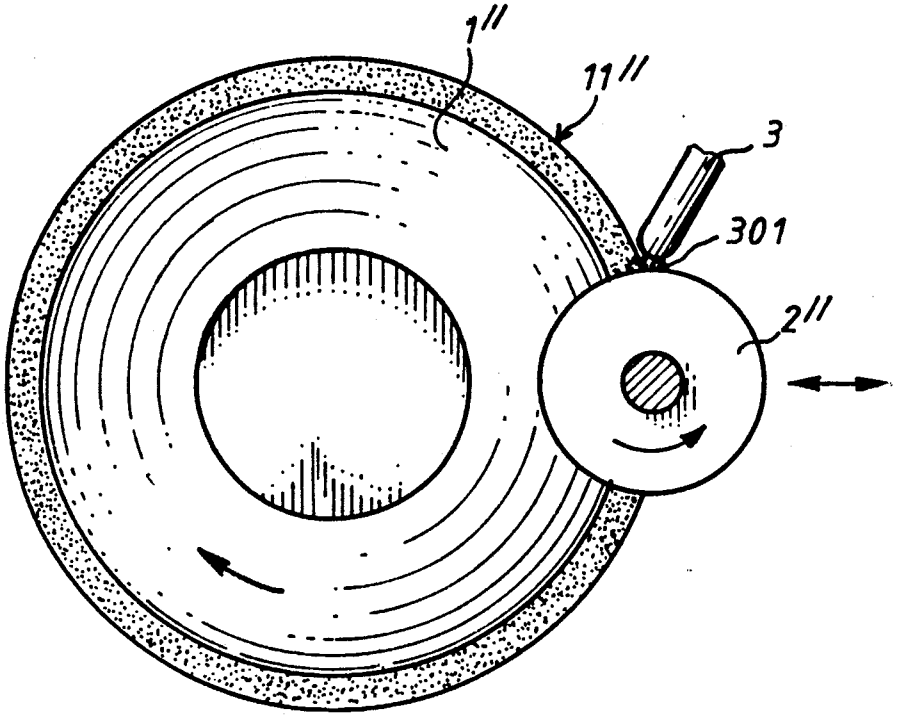

An arrangement according to the invention for dressing a pot-shaped grinding disc 1'' having an annular-shaped grinding face 11'' and a pot-shaped carrier is shown in FIGS. 4A and 4B. The dressing tool 2'' is cylindrical and lies with its grinding face 201'' against the grinding face 11'' of the pot-shaped grinding disc 1''. Loose abrading means 301 are supplied via a conduit 3 into the gap between the grinding faces 11'' and 201''. The pot-shaped grinding disc 1'' rotates about the axis defined by shaft 12 and the dressing tool 2'' rotates about the axis defined by shaft 23 with the directions of rotation being mutually opposite. The position of the shafts 12 and 23 can be adjusted with respect to each other as required.

It is understood that the foregoing description is that of the preferred embodiments of the invention and that various changes and modifications may be made thereto without departing from the spirit and scope of the invention as defined in the appended claims.

What is claimed is:

1. An arrangement for regenerating a rotating precision grinding tool having a grinding surface which is to be dressed to define a desired shape, the arrangement comprising:

a dressing tool including a body having a surface region formed to have approximately the negative shape of said desired shape of said grinding surface of the grinding tool;

said grinding tool and said dressing tool being positioned relative to each other so as to cause said grinding surface and said surface region to conjointly define a gap therebetween;

said dressing tool carrying bonded abrading grains in said surface region; and, supply means for supplying loose abrading material suspended in a liquid to said gap.

2. The arrangement of claim 1, further comprising means for rotating said grinding tool when dressing said grinding surface of said grinding tool.

3. The arrangement of claim 1, further comprising moving means for moving said dressing tool tangentially to said grinding tool while dressing said grinding surface of said grinding tool.

4. An arrangement for regenerating a rotating precision grinding tool having a grinding surface which is to be dressed to define a desired shape, the arrangement comprising:

a dressing tool including a body having a surface region formed to have approximately the negative shape of said desired shape of said grinding surface of the grinding tool;

said grinding tool and said dressing tool being positioned relative to each other so as to cause said grinding surface and said surface region to conjointly define a gap therebetween;

said dressing tool carrying bonded abrading grains in said surface region;

supply means for supplying loose abrading means suspended in a liquid to said gap;

said grinding tool having a cylindrical grinding surface and said surface region of said dressing tool having a shape corresponding to a portion of an inner cylindrical wall surface defining a longitudinal axis; and, moving means being adapted to move said dressing tool in a direction parallel to said axis.

5. An arrangement for regenerating a rotating precision grinding tool having a grinding surface which is to be dressed to define a desired shape, the arrangement comprising:

a dressing tool including a body having a surface region formed to have approximately the negative shape of said desired shape of said grinding surface of the grinding tool;

said grinding tool and said dressing tool being positioned relative to each other so as to cause said grinding surface and said surface region to conjointly define a gap therebetween;

said dressing tool carrying bonded abrading grains in said surface region;

supply means for supplying loose abrading means suspended in a liquid to said gap;

said grinding tool defining a rotational axis and having a grinding surface corresponding to an outer surface of a layer of a sphere;

drive means for driving said grinding tool for rotation about said rotational axis;

said surface region of said dressing tool having a shape corresponding to a portion of an inner spherical wall surface defining a radial axis perpendicular to said rotational axis; and, said moving means being adapted to rotate said dressing tool about said radial axis.

6. A method for regenerating a rotating precision grinding tool having a grinding surface which is to be dressed to define a desired shape, the method comprising the steps of:

providing a dressing tool which includes a body having a surface region formed to have approximately the negative shape of said desired shape of said grinding surface of said grinding tool and carrying bonded abrading grains in said surface region;

positioning said grinding tool and said dressing tool relative to each other so as to cause said grinding surface and said surface region to conjointly define a gap;

introducing a slurry into said gap which includes a liquid and loose abrading material suspended in said liquid; and, adjusting said gap, the grain size of said dressing tool and the concentration of said abrading material in said liquid to, in turn, adjust the cutting force of said abrading grains on said grinding surface to be dressed.

7. The method of claim 6, wherein said grinding surface is rotated.

8. The method of claim 6, wherein said dressing tool is moved tangentially to said grinding surface.

9. The method of claim 6, wherein said grinding tool is rotated and said dressing tool is moved simultaneously tangentially to said grinding surface.

* * * * *